US006047848A

United States Patent [19]

Davis

[11] Patent Number: 6,047,848

[45] Date of Patent: Apr. 11, 2000

[54] COLLAPSIBLE CONTAINER

[76] Inventor: Rex C. Davis, 5601 Orange Rd. North, Seminole, Fla. 33772

[21] Appl. No.: 09/176,873

[22] Filed: Oct. 22, 1998

[51] Int. Cl.[7] ..... B65D 6/18

[52] U.S. Cl. ..... 220/666; 215/382; 220/905

[58] Field of Search ..... 220/666, 6, 562, 220/905, 756; 215/382; 222/568; 141/2

[56] References Cited

U.S. PATENT DOCUMENTS

| | | | |
|---|---|---|---|
| 3,083,877 | 4/1963 | Gash | 222/107 |
| 3,474,844 | 10/1969 | Lindstrom | 220/666 |
| 4,157,103 | 6/1979 | La Fleur | 141/98 |
| 5,020,702 | 6/1991 | James | 222/529 |
| 5,174,458 | 12/1992 | Segati | 215/1 C |
| 5,447,110 | 9/1995 | Brown | 141/2 |
| 5,562,221 | 10/1996 | Beniacar | 215/386 |
| 5,615,791 | 4/1997 | Vatelot et al. | 215/382 |
| 5,740,942 | 4/1998 | Araujo, Jr. | 220/666 |

*Primary Examiner*—Stephen Castellano
*Attorney, Agent, or Firm*—Joseph N. Breaux

[57] ABSTRACT

A collapsible container comprising a body having a bottom portion, a top portion and an intermediate accordion fold style portion. The top portion has a fill mouth and a vent opening, so that a liquid can be inserted through the fill mouth when the body is in an extended mode. A pour spout engages with the fill mouth in a removable manner, so as to allow the liquid to pour out therefrom. A facility is for holding the body in a collapsed mode being approximately one quarter the height of the extended mode when not in use, for easy storage and transportation.

1 Claim, 2 Drawing Sheets

COLLAPSIBLE CONTAINER

TECHNICAL FIELD

The present invention relates to containers and more particularly to a collapsible container. The collapsible container consists of an accordion fold style body having a fill mouth, a vent opening, a vent cap, and a fill securing cap. The fill securing cap has a threaded rod extending downward from the center thereof that will thread into an integrated nut that is at the bottom interior of the body. When the threaded rod is threaded into the integrated nut, the body is held in the collapsed mode.

BACKGROUND ART

Numerous containers have been provided in prior art. For example, U.S. Pat. Nos. 3,083,877 to Gash; 4,157,103 to La Fleur; 5,174,458 to Segati; 5,447,110 to Brown; 5,562,221 to Beniacar and 5,740,942 to Araujo, Jr. all are illustrative of such prior art. While these units may be suitable for the particular purpose to which they address, they would not be as suitable for the purposes of the present invention as heretofore described.

The Gash U.S. Pat. No. 3,083,877 discloses a collapsible container with corrugations to facilitate the collapse of its walls. A collapsible container comprising a stiff, flexible synthetic plastic material defining an enclosure substantially rectangular in plan view and having rounded corners. The material providing top and bottom walls and back and side walls integral with one another. The top wall having an eccentric opening. An externally threaded upstanding tubular neck is in the opening. The walls defining corrugations extending horizontally around the surface of the container. The corrugations comprising alternating ridges and valleys constituting a plurality of normally extended accordion pleats having fold lines coincidental with the ridges and valleys and extending parallel to one another horizontally around the surface of the container. The material having a thickness to normally enable self support of the container but permitting vertical collapse of the container under the action of a vertical compression force on the container. The top and bottom walls having rounded peripheral portions to strengthen the container to permit supporting a liquid contained in the container. The rounded peripheral portions of the top and bottom walls being provided with spaced narrow horizontal fold lines extending around each of the rounded corners thereof. The latter fold lines enabling collapse of the container under the action of a vertical compression force with the container unfilled while substantially unaffecting the increased strength provided by the rounded peripheral portions for supporting liquids in the container.

The La Fleur U.S. Pat. No. 4,157,103 discloses a container. A container molded in full capacity configuration and which is collapsible accordion-fashion to a storage configuration.

The Segati U.S. Pat. No. 5,174,458 discloses a collapsible container. A collapsible container having substantially planar front and rear walls and interconnecting side walls that define inwardly extending V-shaped panels. A plurality of transversely extending stiffening grooves are provided in the front and rear panels to minimize outward bulging of the front and rear panels when the bottle is filled with a liquid material. A plurality of bridging members is formed in the side panels to bridge the adjacent side panels at a longitudinal fold line to minimize outward bulging of the side wall when the container is filled with liquid. To collapse the container the front and rear panels are urged together, and the side panels move inwardly about the longitudinal hinge line so that the bottle assumes a flat condition. The flattened bottle occupies considerably less space in waste disposal facilities.

The Brown U.S. Pat. No. 5,447,110 discloses a collapsible container. To store an emergency container in the hub cavity of a spare tire within the truck compartment of an automobile with a spare tire. The container is collapsible, having a top end and a bottom end with handles on each of the top end and bottom end to permit the container to be expanded. An opening extends along the axis of the container to receive a spindle for holding the collapsed container in the center of the spare tire until needed. The walls of said container containing foldable members to permit collapsing and opening of the container.

The Beniacar U.S. Pat. No. 5,562,221 discloses a foldable bottle with fastening element. A bottle is made of flexible material which can be folded or rolled up into a deformed configuration of limited dimensions. The bottle comprises, between the pouring neck and side walls, elements which engage with a fastening element which can be fitted onto the bottle to keep it in the deformed configuration.

The Araujo, Jr. U.S. Pat. No. 5,740,942 discloses a collapsible container. The present invention relates to a new and improved collapsible container for use in transporting and dispensing fluids, primarily gasoline. In its broadest context, the present invention includes a flexible liner with at least three sides. Furthermore, metallic reinforcing walls are secured to at least two of these walls. Due to the material characteristics of the reinforcing walls, specifically a memory steel, a spring force is created which tends to urge the reinforcing walls inwardly. However, the presence of a fluid within the container overcomes this spring force and keeps the container in its non-collapsed or opened configuration.

GENERAL SUMMARY OF DISCUSSION OF INVENTION

The collapsible container consists of a rectangular body fabricated of plastic with an accordion style center section allowing the body to collapse when empty to approximately one quarter the expanded height. The top of the body features a fill mouth with a fill securing cap and a threaded vent opening with a lanyard attached vent cap. The fill securing cap has an extended threaded rod which serves to screw into an integrated nut attached to the bottom interior of the body, to hold the body in a collapsed mode when not in use. A removable pour spout is also provided. The top of the body has an upper recessed handle with an integral U-shaped top channel clamp, allowing the pour spout to be retained into the channel clamp for storage. The bottom of the body has a lower recessed handle that is used to assist in pulling the body into an expanded mode for use and also as an aid in holding the body stable, while pouring a liquid therefrom. The collapsible container can be utilized as standard equipment on all newly sold motor vehicles.

A primary object of the present invention is to provide a collapsible container that will overcome the shortcomings of the prior art devices.

Another object is to provide a collapsible container that consists of an accordion type body which when collapsed will be reduced in height by about one half its normal extended height, so that it can be stored in a small area, such as in a trunk of a motor vehicle.

An additional object is to provide a collapsible container in which the accordion type body can be extended in height to hold a proper amount of consumable liquids, such as gasoline, water or a beverage, and can be used for camping, boating or any other use where space is a consideration.

A further object is to provide a collapsible container that is simple and easy to use.

A still further object is to provide a collapsible container that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

Similar reference characters denote corresponding features consistently throughout the attached drawings.

EXEMPLARY MODE FOR CARRYING OUT THE INVENTION

Figure 1:
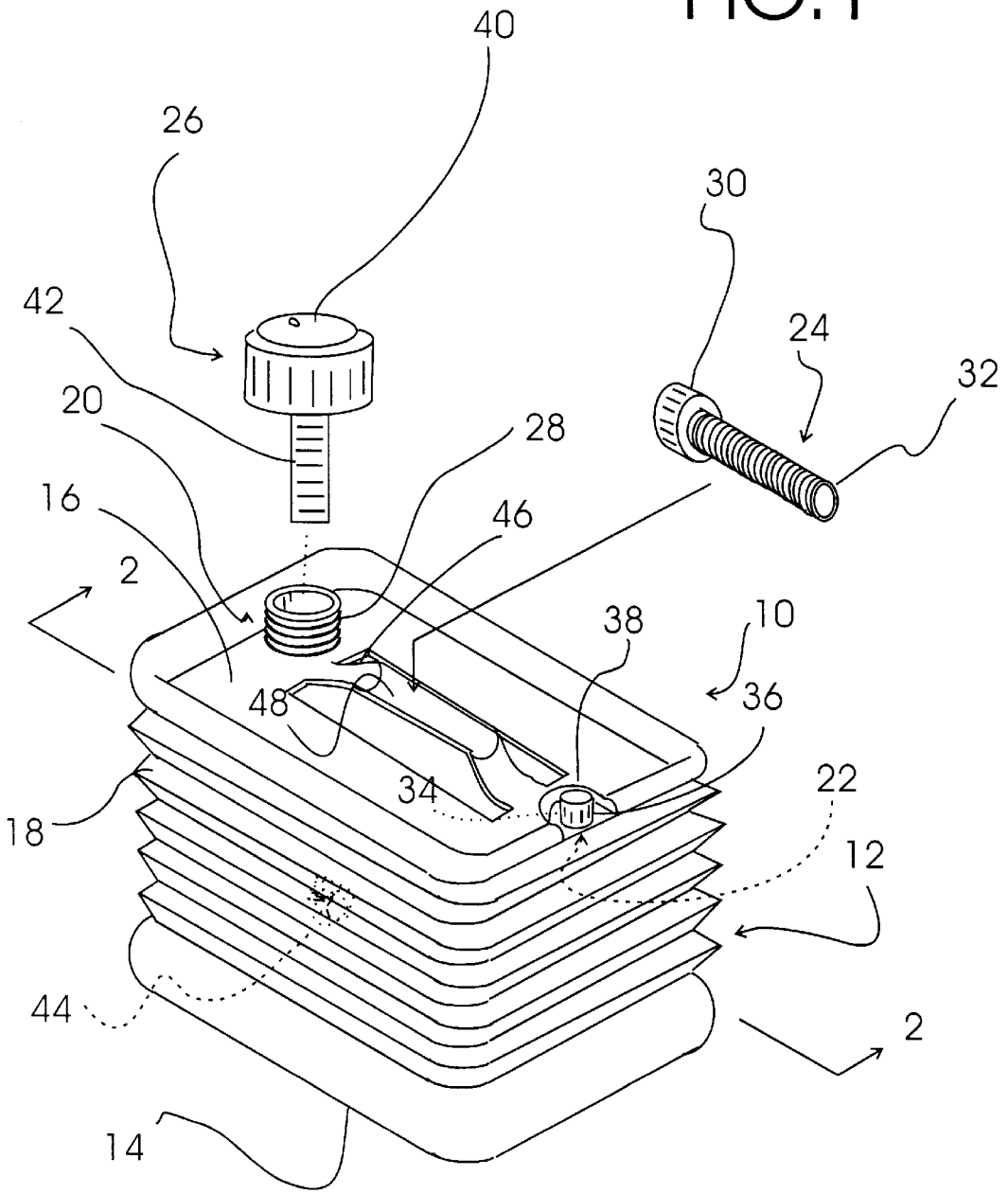
FIG. 1 is a perspective view of the present invention.
Figure 2:
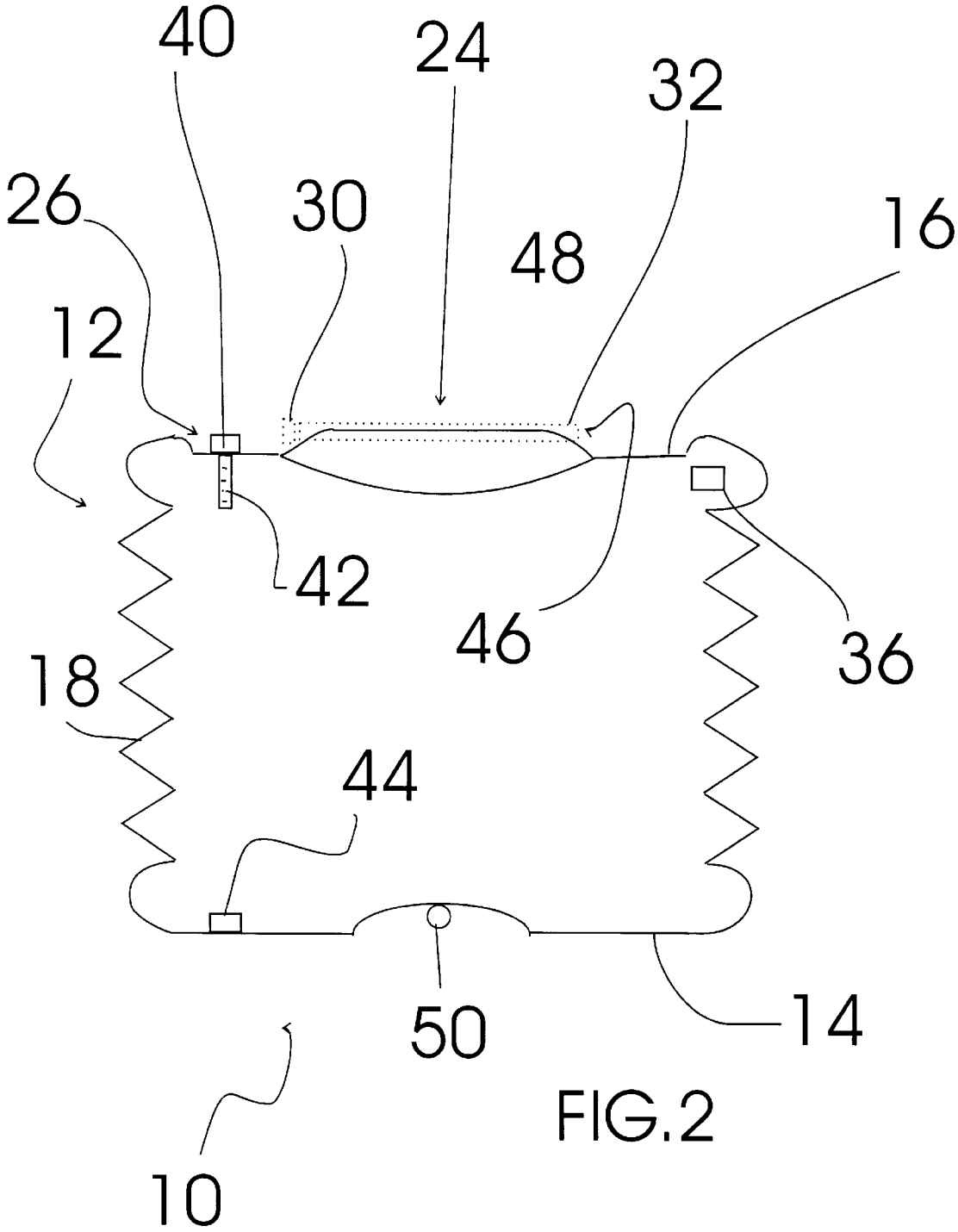
FIG. 2 is a diagrammatic cross sectional view taken along line 2—2 in FIG. 1.

Turning now descriptively to the drawings, in which similar reference characters denote similar elements throughout the several views, FIGS. 1 and 2 illustrate the various features of the present invention being a collapsible container 10 comprising a body 12 having a bottom portion 14, a top portion 16 and an intermediate accordion fold style portion 18. Top portion 16 has a fill mouth 20 and a vent opening 22, so that a liquid can be inserted through fill mouth 20 when body 12 is in an extended mode. A pour spout 24 engages with fill mouth 20 in a removable manner, so as to allow the liquid to pour out therefrom. A facility 26 holds body 12 in a collapsed mode being approximately one quarter the height of the extended mode when not in use, for easy storage and transportation.

The fill mouth 20 is an externally threaded upstanding tubular neck 28 integrally formed on top portion 16 of body 12. The pour spout 24 includes an internally threaded connector 30 to engage with externally threaded upstanding tubular neck 28. A flexible tube 32 extends from internally threaded connector 30. The vent opening 22 is an upstanding collar 34 integrally formed on top portion 16 of body 12. A vent cap 36 engages with upstanding collar 34 in a removable manner. A lanyard 38 extends between vent cap 36 and top portion 16 of body 12 to prevent loss of vent cap 36.

Holding facility 26 consists of an internally threaded fill securing cap 40 to engage with externally threaded upstanding tubular neck 28. A threaded rod 42 extends downward from the center of fill securing cap 40. An integrated nut 44 on an interior surface of bottom portion 14 is directly under externally threaded upstanding tubular neck 28. Threaded rod 42 will thread into integrated nut 44 when body 12 is depressed into the collapsed mode.

An upper recessed handle 46 with an integral U-shaped top channel clamp 48 is formed onto top portion 16 of body 12, so that pour spout 24 can be retained into the channel clamp 48 for storage. A lower recessed handle 50 formed onto bottom portion 14 of body 12 is used to assist in pulling body 12 into the expanded mode for use, and also as an aid in holding body 12 stable while pouring the liquid out through pour spout 24.

It can be seen from the preceding description that in use a person will simply store the collapsible container 10 in its collapsed mode conveniently out of the way, such as in the trunk of a motor vehicle until such time as required for use. When needed, the person will remove the fill securing cap 40 from fill mouth 20 and grasp upper and lower handles 46, 50 to pull body 12 into the expanded mode. Body 12 will be filled through fill mouth 20 with fuel, water or beverage, the fill securing cap 40 replaced onto fill mouth 20 and transported to a desired location. When the person wants to pour the fuel, water or beverage, fill securing cap 40 is removed, the pour spout 24 installed, vent cap 36 unscrewed from vent opening 22 and the fuel, water or beverage poured out as desired with the use of upper and lower handles 46, 50 for stability. When empty, pour spout 24 is removed and clipped back into the channel clamp 48 on the upper handle 46. Body 12 is then depressed back to the collapsed mode and fill securing cap 40 with extended threaded rod 42 tightened down, so that threaded rod 42 screws into integrated nut 44 effectively connecting top portion 16 of body 12 to bottom portion 14, forcing body 12 to stay in the collapsed mode for storage. Use of the collapsible container 10 provides a very practical, and easy way of allowing anyone to have the collapsible container 10 for an emergency, without taking up valuable storage space.

It is noted that the embodiment of the collapsible container described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A collapsible container comprising:

a body having a bottom portion, a top portion and an intermediate accordion fold style portion;

said too portion having a fill mouth and a vent opening, so that a liquid can be inserted through said fill mouth when said body is in an extended mode;

a pour spout to engage with said fill mouth in a removable manner, so as to allow the liquid to pour out therefrom; and means for holding said body in a collapsed mode being approximately one quarter the height of the extended mode when not in use, for easy storage and transportation;

said fill mouth being an externally threaded upstanding tubular neck integrally formed on said top portion of said body;

said holding means including an internally threaded fill securing cap to engage with said externally threaded upstanding tubular neck, a threaded rod extending downward from the renter of said fill securing car, and an integrated nut on an interior surface of said bottom portion directly under said externally threaded upstanding tubular neck, so that said threaded rod will thread into said integrated nut when said body is depressed into the collapsed mode.

* * * * *